US006896255B1

(12) United States Patent
Fick et al.

(10) Patent No.: US 6,896,255 B1
(45) Date of Patent: May 24, 2005

(54) SHEET EXTRACTING DEVICE WITH A CASSETTE FOR RECEIVING A STACK OF SHEETS

(75) Inventors: Wolfgang Fick, Borchen (DE); Günter Baitz, Berlin (DE); Wolfgang Malke, Berlin (DE)

(73) Assignee: Siemens Nixdorf Informationssyteme Aktiengesellschaft, Paderborn (DE)

( * ) Notice: Subject to any disclaimer, the term of this patent is extended or adjusted under 35 U.S.C. 154(b) by 0 days.

(21) Appl. No.: 08/256,422

(22) PCT Filed: Dec. 11, 1992

(86) PCT No.: PCT/DE92/01038

§ 371 (c)(1),
(2), (4) Date: Jul. 7, 1994

(87) PCT Pub. No.: WO93/14475

PCT Pub. Date: Jul. 22, 1993

(30) Foreign Application Priority Data

Jan. 7, 1992 (DE) ..... 42 00 186

(51) Int. Cl.[7] ..... B65H 1/08

(52) U.S. Cl. ..... 271/126; 271/149; 271/155; 271/160

(58) Field of Search ..... 271/31.1, 126, 271/129, 130, 149, 154, 155, 156, 160, 152

(56) References Cited

U.S. PATENT DOCUMENTS 4,978,416 A * 12/1990 Potter et al. ..... 271/126
5,100,022 A * 3/1992 Fukudom et al. ..... 271/149
5,335,899 A * 8/1994 Golicz ..... 271/126

FOREIGN PATENT DOCUMENTS

| | | | |
|---|---|---|---|
| DE | 3434780 | 3/1986 | |
| EP | 0 280 899 | 9/1988 | |
| EP | 0 364 790 | 4/1990 | |
| FR | 2649086 | * 1/1991 | ..... 271/149 |

* cited by examiner

*Primary Examiner*—H. Grant Skaggs
(74) *Attorney, Agent, or Firm*—Hill, Steadman & Simpson

(57) ABSTRACT

The invention relates to a cassette for receiving a stack of sheets, with a pressing element which bears against a first end face of the stack of sheets and is movable in the pressing direction, with a drive motor for displacing the pressing element so that a second end face the stack of sheets facing away from the pressing element can be brought to bear against extracting elements of a sheet extracting device, and with a measuring device for determining the pressing force of the stack of sheets against the extracting elements an output signal of the measuring device serving for controlling the drive motor in order to generate a predetermined pressing force. The stack of sheets and the pressing element are arranged in a slide which is accommodated in the cassette movably in the direction of displacement of the pressing element, the pressing element being displaceable with respect to the slide by the drive motor. The slide is pressed by a displacement-dependent force in the direction of the extracting elements.

22 Claims, 5 Drawing Sheets

SHEET EXTRACTING DEVICE WITH A CASSETTE FOR RECEIVING A STACK OF SHEETS

BACKGROUND OF THE INVENTION

1. Field of the Invention

Generally, the invention relates to a sheet extracting device having a cassette for receiving a stack of sheets, and having a pressing element which bears against a first end face of the stack of sheets and is movable in the pressing direction. More specifically, the invention relates to such a device wherein a drive motor displaces the pressing element so that a second end face of the stack of sheets can be pressed against extracting elements. Furthermore, the invention relates to a sheet extracting device having a measuring device for determining the pressing force of the second end of the stack of sheets against the extracting elements, wherein an output signal of the measuring device controls the drive motor to generate a predetermined pressing force.

2. Description of the Related Art

Cassettes are used in sheet extracting devices, particularly in automatic banknote dispensers. A stack of banknotes located in the cassette is pressed by a pressing element against an end wall of the cassette, which is designed such that the respectively forwardmost banknote is in contact with extracting elements reaching through the end wall. These extracting elements are normally extracting rollers, but may also be extracting fingers or the like.

It is already known to press the stack of banknotes by a spring biased pressing plate against the extracting elements, the pressing plate triggering the control of a pressing slide by means of a displacement sensor. In such a device, it is, difficult to maintain constant pressing force, since the friction of the banknotes in the cassette changes with the number of banknotes in the stack and according to their condition (bends, folds and the like).

In the case of a known sheet extracting device such as that disclosed in German Patent No. DE34 34 780 C2, the stack of banknotes is pressed against the extracting rollers by a pressing plate, which is displaced in the cassette by a drive motor. The pressing force of the extracting rollers against the forwardmost banknote is measured and used for controlling the drive motor.

Although the pair at sheet extracting device operates satisfactorily, it has been difficult to measure the pressing force, which can be carried out at the bearings of the extracting roller shaft if the latter is movably mounted.

SUMMARY OF THE INVENTION

The object of the present invention is to provide a novel cassette of the type mentioned at the beginning which ensures a constant pressing force by simple means.

This object is achieved according to the invention by providing a sheet extracting device having a cassette for receiving a stack of sheets. A pressing element bears against a first end face of the stack of sheets and is movable in a pressing direction. The device includes extracting elements for contacting a sheet at a second end face of the stack opposite the first end face. A drive motor is provided for displacing the pressing element so that the second end face of the stack of sheets can be brought to bear against the extracting elements with a first force. A measuring device determines the pressing force of the stack of sheets against the extracting elements. The measuring device generates an output signal corresponding to the first force for controlling the drive motor in order to generate a predetermined second force by the pressing element against the first end. A slide holds the stack and the pressing element which is accommodated movably in the cassette in the direction of displacement of the pressing element. The pressing element is displaceable with respect to the slide by the drive motor. The invention includes a means for generating a displacement-dependent force which presses the slide in the direction of the extracting elements.

According to the invention, there is thus arranged in the cassette a movable slide which carries the stack of sheets, the pressing element and the drive motor for it and which is pressed by a displacement-dependent force forward against the extracting elements of a sheet extracting device. In this case, the slide is held in the position in which the displacement-dependent force just corresponds to the pressing force against the extracting elements required for a successful extraction.

The pressing force for the stack of sheets against the extracting elements can thus be kept constant in a simple way by the slide carrying the stack of sheets being held in a predeterminable position in the cassette. It is of particular advantage in this case that the force acting on the slide generates the pressing force independently of the friction of the stack of sheets on the slide and of the condition of the sheets of the stack of sheets.

Thus, troublefree operation of the sheet extracting device irrespective of the quality of the sheets is ensured by the cassette according to the invention. Consequently, in automatic banknote dispensers it. is possible to dispense newly issued and used notes equally unproblematically.

A suitable mounting for the movable slide is provided by mounting the slide in the cassette on balls or rollers.

The embodiment wherein the slide is suspended in the cassette by means of rocker arms; is also suitable for a sheet extracting device in which the stack of sheets is arranged vertically.

The displacement-dependent force can be generated particularly simply by a spring arrangement. An embodiment includes a spring arrangement between the slide and the cassette. In another embodiment, the spring arrangement is a compression spring arrangement provided between a rear end wall of the slide and a rear end wall of the cassette. In a further embodiment, the spring arrangement is formed by tension springs provided between the rocker arms and the cassette.

To achieve an accurate and reliable displacement of the pressing element, in an embodiment, the drive motor for the pressing element is a stepping motor and a motor drive element is in positive engagement with the slide.

This is particularly advantageous if a displacement sensor is arranged between the slide and the cassette as a measuring device. As a result, not only can the pressing force be kept constant in a particularly simple way, so that the frictional force between the extracting element and the forwardmost sheet changes only within very small limits in dependence on the quality of this sheet, but the pressing force can also be adapted in a simple way if so required.

In a further embodiment of the invention the slide has a front end which faces the extracting elements. A bearing means for the second end face of the stack of sheets faces away from the pressing element. The pressing element has a pressing slide and a pressing plate. The pressing plate is movable in relation to the pressing slide in the pressing direction by a displacement-dependent force. The measuring device has a displacement sensor between the pressing plate and the pressing slide. In this case, the frictional force of the forwardmost sheet against a bearing means is dependent only on the pressing force which is generated by the pressing element arranged on the slide, and not on the pressing force acting against the extracting element. Consequently, the ratio of these forces can be chosen essentially freely in order to ensure unproblematical sheet extraction.

Advantageous further developments of this embodiment provide the pressing plate mounted on the pressing slide by means of a scissors-type linkage. In another embodiment, the force acting between pressing slide and pressing plate is provided a by a spring arrangement. In a related embodiment, the spring arrangement includes springs in compression. In a further embodiment, the spring arrangement supported on the pressing slide acts on a joint of the scissors-type linkage.

In the case of a particularly simple further development of the invention, the displacement sensor includes a position switch which controls the switching-on state of the drive motor and which is actuated by the slide. In yet another embodiment, the position switch is formed by a set of spring contacts.

Another further development of the invention is distinguished in that the displacement sensor is a magnetic sensor, the output signal of which is applied to a control device.

As a result, a signal proportional to the displacement path of the slide in the cassette is received by the displacement sensor, so that production-dependent tolerances of the slide and of the compression spring arrangement can be sensed and taken into account when setting the pressing force.

In this case, the sensor is expediently designed such that the displacement sensor is an inductive displacement sensor which has a magnetic coil connected to the cassette and a rod arranged on the slide for plunging into the magnetic coil.

In order to be able to adapt the open-loop or closed-loop control of the pressing force to various intended applications as simply as possible, the design of the invention include an open-loop control device having a microcomputer which drives the drive motor by means of a driver and wherein the microcomputer is assigned a memory in which at least one predetermined value for a value of the output signal of the sensor corresponding to the required second force is stored.

For controlling the pressing force on a stack of sheets arranged in a cassette against extracting elements in a sheet extracting device, a value corresponding to the pressing force is normally sensed and compared with a set value in order to form an actuating signal which acts on a drive motor for generating a predeterminable pressing force.

However, it may be so in this case that the required pressing force on the extracting elements cannot always be set successfully, as a result of which malfunctions which are not immediately noticeable may occur. For solving this problem, a maximum second force is generated and a corresponding maximum value is stored. Then, a minimum second force is generated and a corresponding minimum value is stored. A required second force is determined and set at a corresponding set value less than the maximum value and greater than the minimum value so that the output signal of the sensor corresponds to the predetermined value.

Thus, according to the invention, it is established before setting the required pressing force whether a maximum and a minimum pressing force can be set. If this is not possible, an error message can occur immediately. This is a simple way of preventing a faulty cassette causing malfunctions in a sheet extracting device.

The adjustability of the set value allows the invention to be used in particular for vertically upright cassettes, since it is possible to compensate for the changing weight of the stack of sheets as and when required. In this case too, it is ensured by appropriate test steps that the required pressing force can be set, thereby avoiding malfunctions.

Additional features and advantages of the present invention are described in, and will be apparent from, the detailed description of the presently preferred embodiments and from the drawings.

BRIEF DESCRIPTION OF THE DRAWINGS

The invention is described in more detail below with reference to the drawing, in which.

DETAILED DESCRIPTION OF THE PREFERRED EMBODIMENTS

Figure 1:
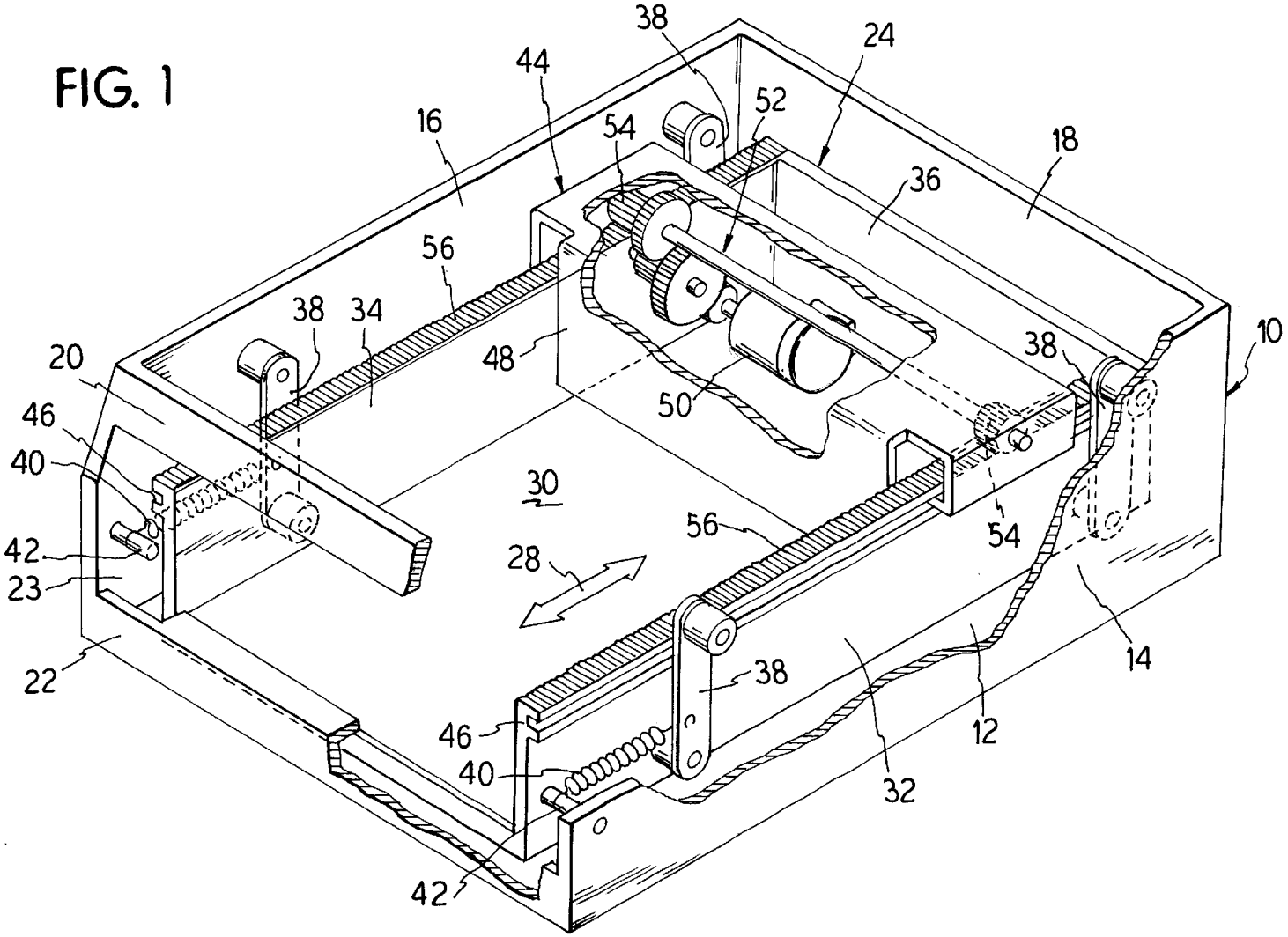
FIG. 1 shows a diagrammatic perspective view of a cassette for a sheet extracting device.

In the various figures of the drawing, components corresponding to one another are denoted by the same reference symbols.

The cassette 10 represented in FIG. 1 comprises a bottom 12, two side walls 14, 16 and a rear end wall 18 and has a cover (not shown). At the front end face, the side walls 14, 16 are connected to each other by an upper bar 20 and a web 22 protruding upward from the bottom 12, so that a window 23 is formed.

A slide 24 for receiving a stack of sheets 26 (FIG. 2), in particular a pack of banknotes, is arranged displaceably in the cassette 10 in the longitudinal direction of the latter, as indicated by the double-headed arrow 28. The slide 24 comprises a bottom 30, side walls 32, 34 and a rear end wall 36. For the displaceable arrangement of the slide 24, on the outside of its two side walls 32, 34 there are in each case two rocker arms 38 articulated by their lower ends, which arms are pivotably connected by their upper ends on the inside to the side walls 14, 16 of the cassette 10.

In order to move the slide 24 forward, tension springs 40 are fastened by their one ends on the front rocker arms 38 and act by their other ends on abutments 42, which are provided on the inside in the region of the front end face of the cassette 10 on the side walls 14, 16 of the latter.

In the slide 24 there is a pressing slide 44 mounted displaceably on rails 46 in the direction of the double-headed arrow 28. The pressing slide 44 has as pressing element a pressing plate 48, which is arranged transversely with respect to the direction of displacement. A drive motor 50 provided in the pressing slide 44 drives via a gear arrangement 52, which can be as a reduction gear having two drive wheels 54 which are designed gear wheels and which mesh with toothed racks 56 provided on the side walls 32, 34 of the slide 24.

Figure 2:
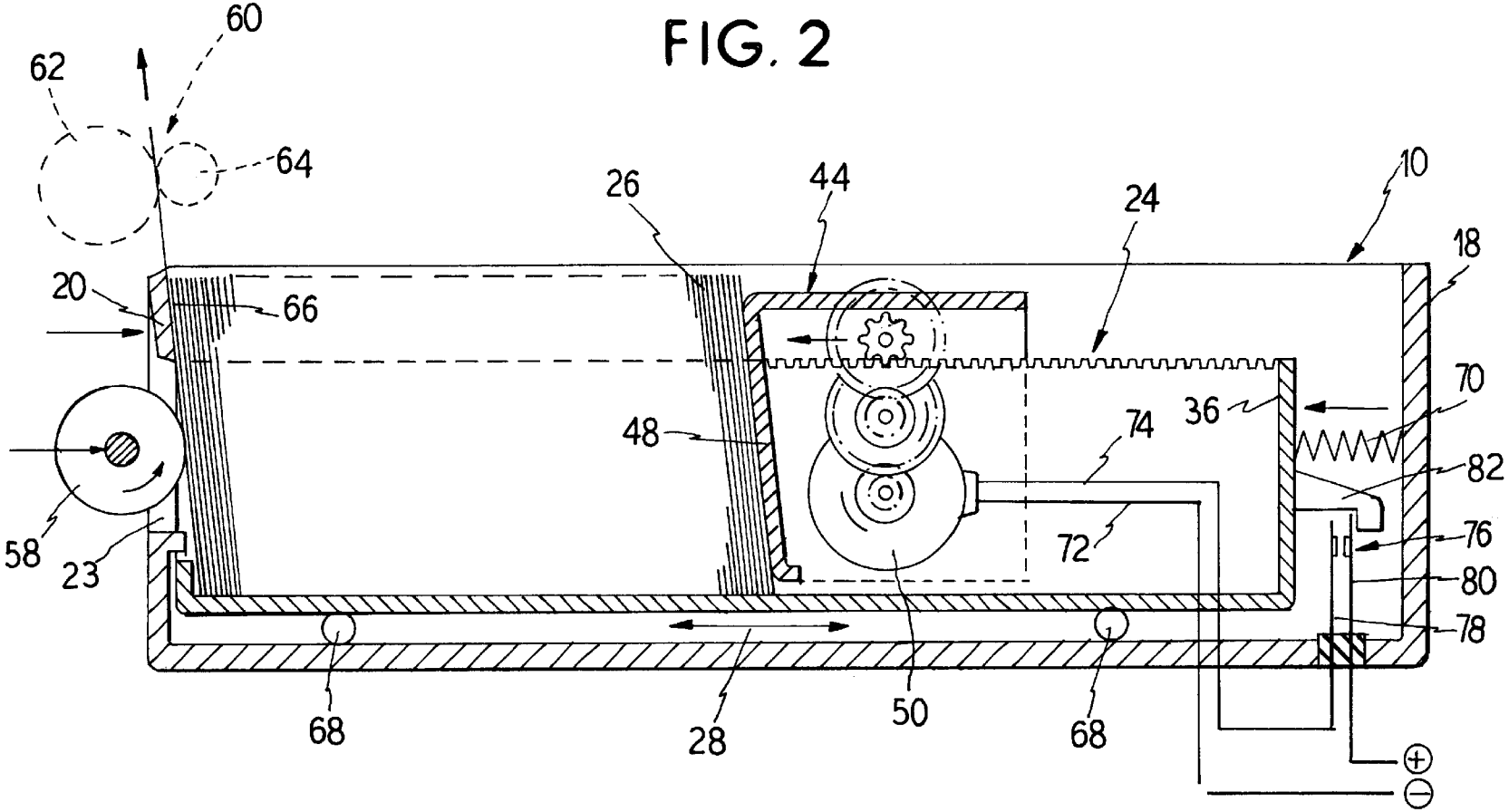
FIG. 2 shows a diagrammatic longitudinal sectional view through a modified cassette, an extracting roller and a separating device of a sheet extracting device being indicated.

As FIG. 2 diagrammatically shows, the cassette 10 is inserted in a sheet extracting device such that an extracting roller or extracting rollers 58 reach through the window 23 in order to come into engagement with the first sheet of the stack of sheets 26.

In order to ensure that, in an individual-sheet separating device 60, the sheets to be dispensed meet first of all the transporting roller 62 and not the counterrunning retaining roller 64, the sheets are arranged in the slide 24 such that they are forwardly inclined. For this purpose, the face 66 of the bar 20 facing the stack of sheets 26 and the pressing plate 48 are inclined parallel to each other in the desired way. In this case there may be mounted in front of the pressing slide 44 a pressing plate which can be pivoted about a horizontal axis but is not shown.

In contrast to the mounting of the slide 24 on rocker arms 38, shown in FIG. 1, the slide 24 represented in FIG. 2 is mounted on balls or rollers 68, and the tension springs 40 are replaced by a compression spring arrangement 70, which is provided between the rear end wall 36 of the slide 24 and the rear end wall 18 of the cassette 10.

The drive motor 50 is connected by means of two lines 72, 74 to a voltage source, there being inserted as a switch in one line 74 a set of contact springs 76, serving as a displacement sensor. The two contact springs 78, 80 of the set of contact springs 76 are in this case arranged fixed to the cassette one behind the other in the direction of displacement of the slide 24. The rear contact spring 80 is engaged around by a hook 82, provided on the slide 24, in order to bring the spring forward into engagement with the front contact spring 78 when there is a displacement of the slide 24. The set of contact springs 76 thus acts as a position switch.

If the pressing slide 44 is displaced forward by the drive motor 50, the stack of sheets 26 is pressed against the extracting roller 58 and against the bar 20. Due to the force of reaction, the slide 24 is pushed rearward by the extraction roller 58 with a force $F_2$ and by the bar 20 with a force $F_3$ against the force $F_1$ generated by the spring arrangement 70, which is equal to the sum of the forces $F_2$ and $F_3$.

In this case, the displacement-dependent force $F_1$ of the spring arrangement 70 is a function of the displacement of the slide 24 relative to the cassette wall 18. The position of the slide 24 is sensed by the set of contact springs 76 serving as the displacement sensor, so that the drive motor 50 is switched off as soon as the slide 24 has reached the position in which the force $F_1$ acting on it has reached the desired value, in order to ensure successful extracting of individual sheets.

The cassette described operates in a sheet extracting device as follows.

After inserting a cassette 10 containing a stack of sheets 26 into a sheet extracting device, the pressing slide 44 is displaced forward by the drive motor 50 until the stack of sheets 26 is clamped in the way shown in FIG. 2 between the pressing plate 48 and the extracting roller 58 and also the bar 20. In this case, the stack of sheets 26 is pressed against the extracting roller 58 with the required force $F_2$.

If individual sheets are then removed from the cassette 10, this force subsides and the slide 24 can be pushed forward by the spring arrangement 70. In this case, the hook 82 presses the rear spring contact 80 against the forward spring contact 78, so that the switch formed by the set of contact springs 76 is closed and the drive motor 50 is switched on. The drive motor 50 thereupon displaces the pressing slide 44 forward, the slide 24 being displaced rearward, due to the force of reaction against the force of the spring arrangement 70 until the slide reaches the position in which it is pressed forward with the set force $F_1$ and in which the contact springs 78, 80 come out of contact again, whereby the drive motor 50 is switched off.

Figure 3:
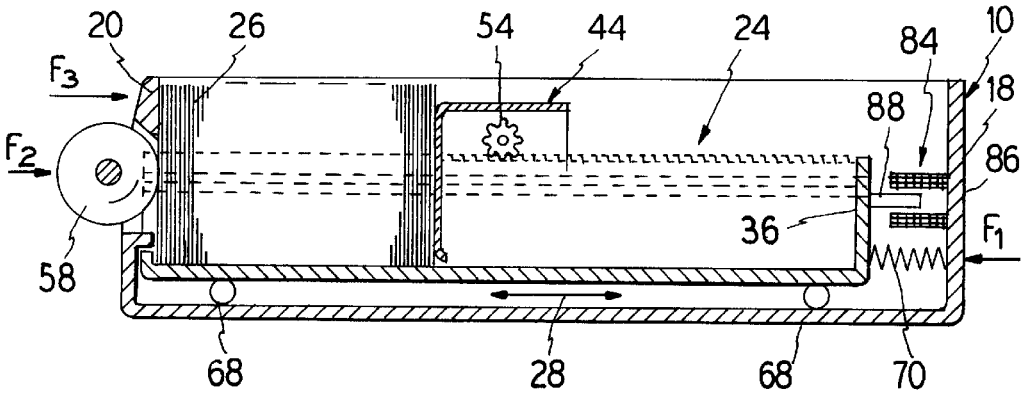
FIG. 3 shows a longitudinal sectional view corresponding to FIG. 2 of an embodiment of a cassette according to the present invention.

The cassette 10 shown in FIG. 3 differs from the one described above in that, instead of the set of contact springs 76, there is provided a magnetic sensor, preferably an inductive displacement sensor 84, which is formed for example by a magnetic coil 86, arranged on the rear end wall 18 of the cassette 10, and a rod 88 which extends movably into the coil and is attached on the rear end wall 36 of the slide 24. The inductive displacement sensor 84 is connected to a control device 90, shown in FIG. 4, for the drive motor, which is preferably designed as a stepping motor 50' (FIG. 4).

Figure 4:
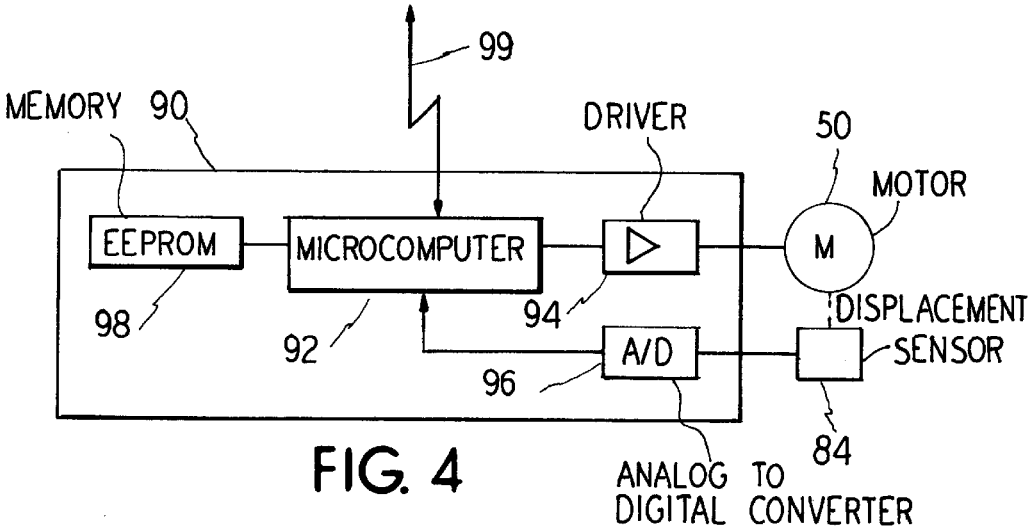
FIG. 4 shows a diagrammatic block diagram of an open-loop control device for a drive motor of the cassette according to FIG. 3, FIGS. 5 to 7 show flow diagrams for an open-loop control process for driving the drive motor of the cassette according to FIG. 3

As FIG. 4 shows, the control device 90 comprises a microcomputer 92, which drives the stepping motor 50' by means of a driver 94. The inductive displacement sensor 84 generates an output signal which is proportional to its inductance, corresponds to the force $F_1$ of the compression spring arrangement 70 and is fed via an analog-digital converter 96 to the microcomputer 92. The microcomputer 92 compares the output signal of the displacement sensor 84 with a set value stored in a memory 98, for example an EEPROM, in order to determine the required driving of the stepping motor 50'.

The open-loop control device 90 has an input and output terminal 98, which is connected to the microcomputer 92 and via which commands indicating control operations to be executed are input and acknowledgment messages and error messages are output. The following control operations can be executed, for example, by the open-loop control device 90: build up pressing force, increase pressing force, reduce pressing force, set minimum pressing force and return pressing slide 44. Furthermore, a measured value for the degree of filling of the cassette can be formed from the number of steps fed to the stepping motor and this value is reported via the terminal 98.

In the case of the exemplary embodiment according to FIGS. 3 and 4, the displacement-dependent control of the drive motor 50' is assumed by the inductive displacement sensor 84 and the open-loop control device 90 connected to the latter. The position of the slide 24 in the cassette 10 is in this case sensed by the inductance of the displacement sensor 84, dependent on the depth to which the rod 88 extends into the magnetic coil 86. Measuring sensors or probes operating on the Hall, piezzo, resistance or capacitance principles may also be used as the displacement sensor 84.

Figure 5:
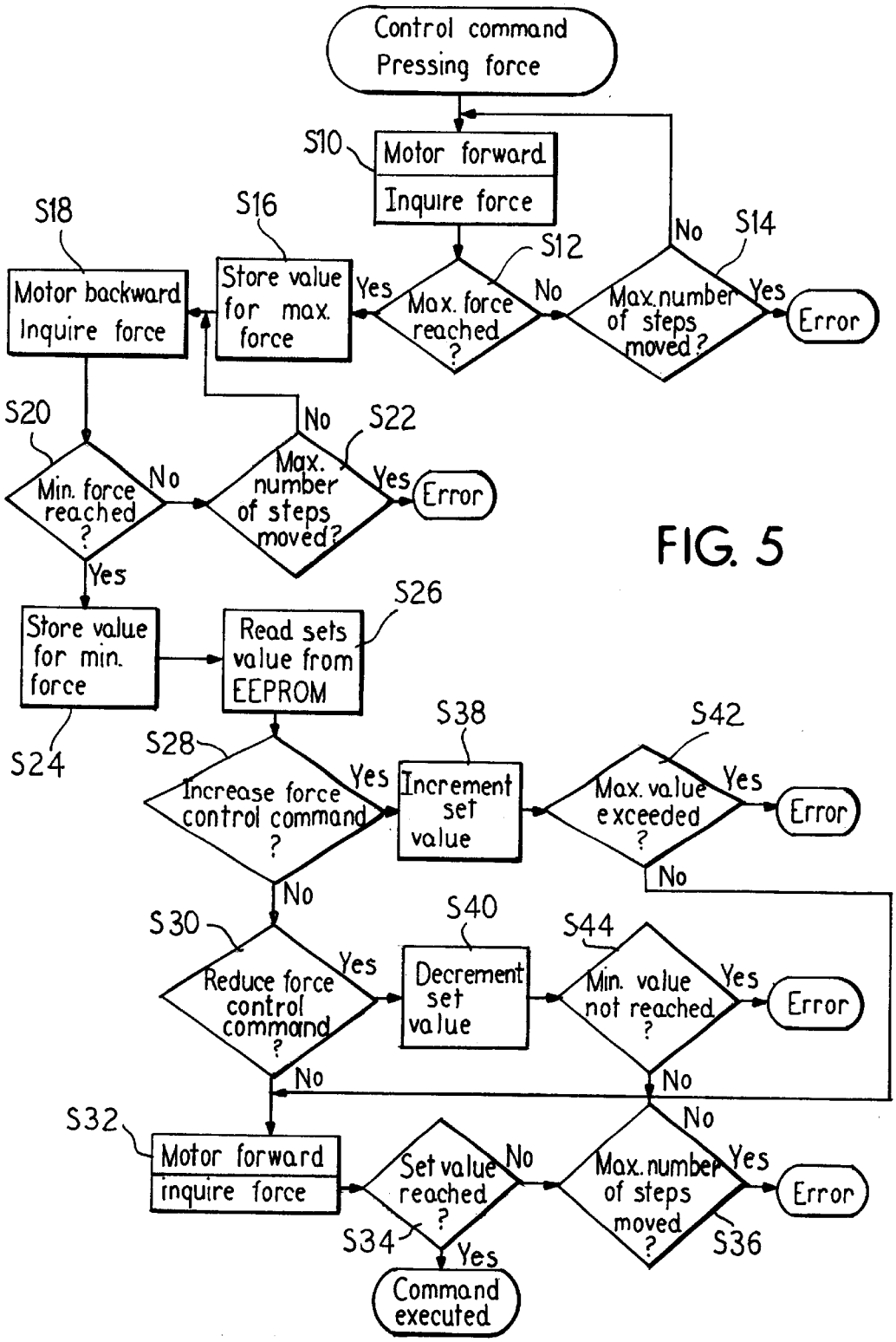

The setting of a pressing force required for successful individual separation and for successful extraction of individual sheets is described with reference to FIG. 5.

For setting the pressing force, in a first step S10 the pressing slide 44 is first of all moved forward by the stepping motor 50' in the pressing direction and the pressing force, that is to say the output signal of the displacement sensor 84, is inquired, or read. In the step S12, it is then established whether the maximum force is reached. The maximum force is reached if, after a further actuation of the stepping motor 50', no further change of the output signal of the displacement sensor 84 can be perceived.

If the maximum force is not reached, it is checked in the step S14 whether the stepping motor 50' was moved the maximum number of steps. If this is the case, an error message is output. Otherwise, the steps S10 and S12 are repeated.

As soon as the maximum force is reached, the corresponding value is stored in step S16. Then, the pressing slide 44 is moved backward by the stepping motor 50' in step S18 and the force is once again inquired. Thereupon, it is checked in step S20 whether the minimum pressing force is reached. The minimum force is reached if, after a further actuation of the stepping motor 50', no further change of the output signal of the displacement sensor 84 can be perceived.

If the minimum force is not reached, it is established in the step S22 whether the stepping motor 50' has executed the maximum number of steps. If this is not the case, the steps S18 and S20 are repeated, otherwise an error is reported.

As soon as the minimum pressing force is set, the corresponding value is stored in step S24. Subsequently, in step S26, the stored set value for the value corresponding to the pressing force is read. Before the pressing force is set, it is checked in step S28 whether there is an "increase pressing force" control command. If not, it is checked in the step S30 whether there is a "reduce pressing force" control command.

If this is also not the case, it can only be a case of the "set pressing force" control command and, in step S32, the pressing slide is moved forward by the stepping motor 50' for setting the desired pressing force and the force is inquired. Thereafter, it is established in step S34 whether the set value is reached. If this is not the case, it is checked again in step S36 whether the stepping motor 50' has executed the maximum number of steps. If not, the steps S32 and S34 are repeated, otherwise an error is reported.

As soon as it is established in the step S34 that the set value is reached, it is reported that the required pressing force is set.

If an "increase pressing force" or "reduce pressing force" control command is established in step S28 or S30, the set value is correspondingly increased or reduced in step S38 or S40, respectively. Subsequently, it is checked in step S42 or S44 whether the maximum value or minimum value determined at the beginning for the pressing force is exceeded or not reached, respectively. If this is the case, a corresponding error message is issued, otherwise the pressing force is set with the changed set value in the steps S32, S34 and S36.

In the case of this procedure, the displacement of the pressing slide 44 by means of the stepping motor 50' thus causes the slide 24 always to be brought into the position within the cassette 10 in which the force $F_1$ generated by the spring arrangement 70 or the tension springs 40 corresponds precisely to the desired pressing force on the first sheet of the stack of sheets 26. In comparison with the exemplary embodiment according to FIG. 2, in this case there is the additional advantage that the pressing force can be changed in a way corresponding to the respective requirements.

Consequently, it is possible to use the cassette 10 both in a horizontal position and in a vertical position, without the spring arrangement 70 or the displacement sensor 84 having to be changed.

After inserting a cassette 10 into a sheet extracting device, as soon as the maximum value and the minimum value for the pressing force have been determined and the pressing force has been built up, it is also possible for the "increase pressing force" and "reduce pressing force" control operations to be executed alone without establishing beforehand the maximum and minimum values for the pressing force.

Figure 6:
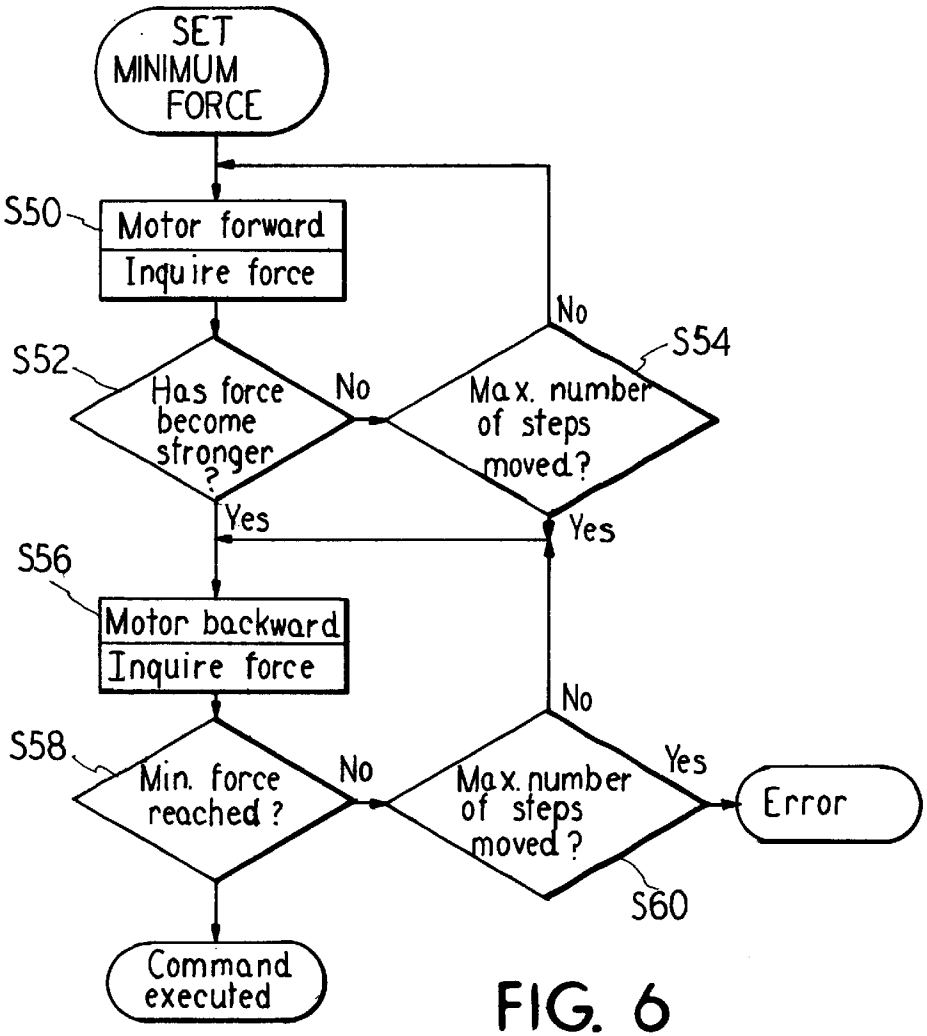

If the cassette 10 is to be prepared for removal from the sheet extraction device or if the sheets are to be secured against falling over after filling, a minimum pressing force must be set. The procedure provided for this is described with reference to FIG. 6.

First of all, in step S50, the stepping motor 50' is moved forward and the value for the pressing force is enquired. Thereupon, it is established in step S52 whether the pressing force has become stronger. If not, it is checked in step S54 whether the stepping motor 50' has executed the maximum number of steps. If this is also not the case, the steps S50 and S52 are repeated.

As soon as the pressing force has become greater, or the stepping motor 50' has been moved the maximum number of steps, the pressing slide 44 is moved backward by the stepping motor 50' in step S56 and the pressing force is enquired. Thereafter, it is checked in step S58 whether the minimum pressing force is set. If there is the minimum pressing force, a corresponding acknowledgment message is issued. Otherwise, it is established in step S60 whether the stepping motor 50' has executed the maximum number of steps. If not, the steps S56 and S58 are repeated, otherwise an error is reported.

The pressing slide 44 is thus moved forward until there is an increase in the pressing force and then moved back until no further reduction of the pressing force can be established. A further moving back of the pressing slide 44 would otherwise entail the risk of the sheets falling over.

Figure 7:
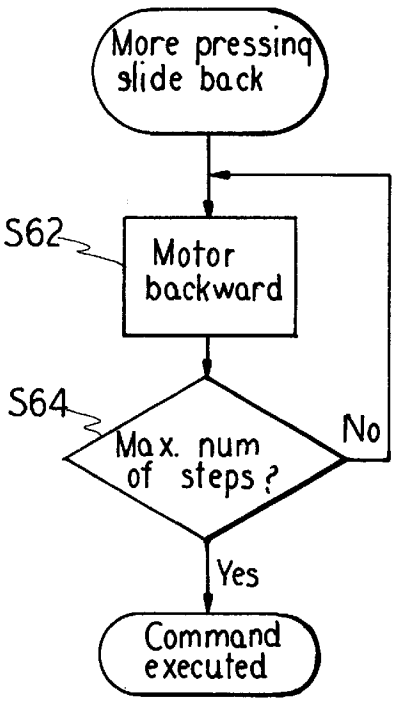

As FIG. 7 shows, for opening or filling the cassette 10, the pressing slide 44 is moved back in step S62, until it has been established in step S64 that the stepping motor 50' has been moved the maximum number of steps.

Figure 8:
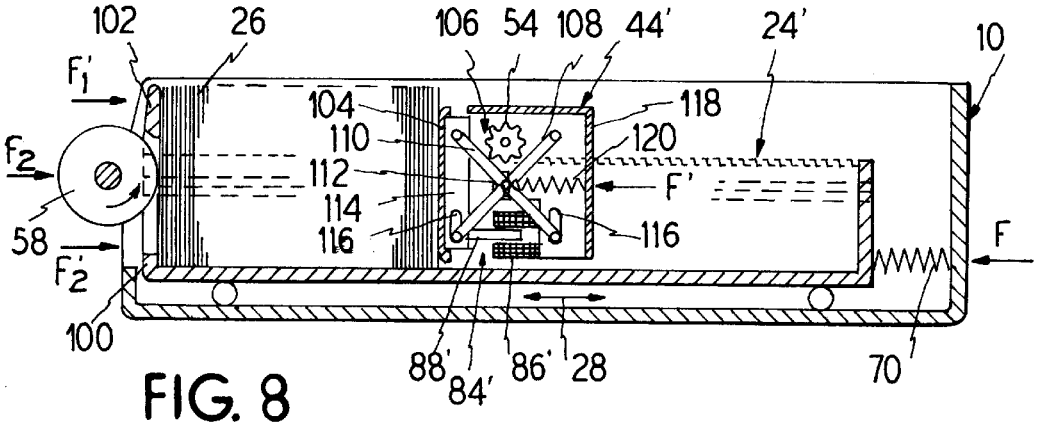
FIG. 8 shows a longitudinal sectional view corresponding to FIG. 2 of a further embodiment of a cassette.

In FIG. 8 a further cassette 10 is shown, in which the slide 24' and the pressing slide 44' are of a different construction. The slide 24' in this case has at its front end, facing the extracting roller 58, as a bearing means for the end face of the stack of sheets 26, facing away from the pressing element, a lower web 100 and an upper bar 102, between which the extracting roller 58 can come into engagement with the first sheet of the stack of sheets 26.

The pressing element comprises a pressing slide 44', which has a drive motor 50 which is not shown in FIG. 8 for the sake of overall clarity, and which interacts with the slide 24' as described with reference to FIGS. 1 to 3. Mounted on the pressing slide 44' by means of a scissors-type linkage 106 is a pressing plate 104 which is displaceable in the pressing direction, that is to say in the direction of the double-headed arrow 28.

The scissors-type linkage 106 has two crossed levers 108, 110, which are connected to each other in their center by a joint 112. The upper ends of the two levers 108, 110 are articulated in a fixed location on a fastening part 114, connected to the pressing plate 104, and on the pressing slide 44'. The lower ends of the levers 108, 110 are mounted in elongate holes 116, which extend substantially perpendicularly with respect to the pressing direction and of which one is arranged in the fastening part 114 and the other is arranged on the pressing slide 44'.

Between the joint 112 and a supporting plate 118, which is arranged on the pressing slide 44' on the side of the joint 112 facing away from the pressing plate 104, there is provided a compression spring arrangement 120. The compression spring arrangement 120 consequently presses the pressing plate 104 against the stack of sheets 26 by means of the scissors-type linkage 106.

In order always to ensure a predetermined pressing force F' for the pressing plate 104, between the pressing plate 104 and the pressing slide 44' there is provided an inductive displacement sensor 84', which has a magnetic coil 86', connected to the pressing slide 44', and a rod 88', connected to the pressing plate 104. The inductive displacement sensor is connected to an open-loop control device, which drives the drive motor.

In operation, the pressing slide 44' is displaced by its drive motor in the direction of the stack of sheets 26, the pressing plate 104 being pressed against the rear end face of the stack of sheets 26. In this case, the stack of sheets 26, which bears with its first sheet against the lower web 100 and the upper bar 102, is pressed together by the spring-loaded pressing plate 104 until the pressing plate 104 is pushed back, owing to the force of reaction of the stack of sheets 26, to such an extent that the compression spring arrangement 120 generates the desired force F'.

The force F' is in this case sensed by the inductive displacement sensor 84'. Upon reaching the desired force F', the drive motor is switched off by the open-loop control device in dependence on the output signal of the displacement sensor 84'. Now the first sheet of the stack of sheets 26 lies precisely in the plane defined by the lower web 100 and the upper bar 102 and is pressed with a force $F_1'$ against the bar 102 and with a force $F_2'$ against the web 100.

The sum of the two forces $F_1'$ and $F_2'$ is in this case equal to the force F' exerted by the pressing plate 104, disregarding frictional forces of the stack of sheets 26 against the slide 24'.

Since the pressing plate 104 presses the stack of sheets 26 only against components which are fixed to the slide, it has virtually no influence on the pressing force with which the stack of sheets 26 is pressed against the extracting roller. Rather, this force $F_2$ is brought about exclusively by the spring arrangement 70 acting on the slide 24'. The force $F_1$, which is equal to the force $F_2$, in this case always remains the same, irrespective of the stack of sheets 26, since the position of the movable slide 24' remains unchanged on account of the precise arrangement of the first sheet of the stack of sheets 26 in the cassette 10.

In order to ensure the pressing force on the extracting roller 58 required for satisfactory extraction of the sheets, it is thus only necessary to press the pressing plate 104 against the stack of sheets 26 with a force F' which ensures that the first sheet of the stack of sheeets 26 is located in its correct position.

Although other modifications and changes may be suggested by those skilled in the art, it is the intention of the inventors to embody within the patent warranted hereon all changes and modifications as reasonably and properly come within the scope of their contribution to the art.

We claim:

1. A sheet extracting device comprising:

(a) a cassette for receiving a stack of sheets;

(b) a pressing element movably mounted in the cassette to bear with a first force against a first end face of the stack of sheets, the pressing element being movable in a pressing direction;

(c) extracting elements positioned to bear with a predetermined second force against a second end face of the stack opposite the first end face;

(d) a drive motor operable to displace the pressing element so that the second end face of the stack of sheets is brought to bear with the second force against the extracting elements;

(e) a measuring device for mounted to determine the second force the measuring device generating an output signal for controlling the drive motor in order to maintain the second force;

(f) a slide for holding the stack and the pressing element which is accommodated movably in the cassette in the direction of displacement of the pressing element being displaceable with respect to the slide by the drive motor and (g) a means are provided for generating a displacement-dependent force, which presses the slide in the direction of the extracting elements.

2. A sheet extracting device as claimed in claim 1, further comprising balls movably mounting the slide in the cassette.

3. A sheet extracting device as claimed in claim 1, further comprising rocker arms suspending the slide in the cassette.

4. A sheet extracting device as claimed in claim 1, wherein the means for generating the displacement-dependant force is comprised of a spring arrangement between the slide and the cassette.

5. A sheet extracting device as claimed in claim 4, wherein the spring arrangement is a compression spring arrangement provided between a rear end wall of the slide and a rear end wall of the cassette.

6. A sheet extracting device as claimed in claim 4 further comprising: rocker arms suspending the slide in the cassette, and wherein the spring arrangement is tension springs provided between the rocker arms and the cassette.

7. A sheet extracting device as claimed in claim 1 wherein the drive motor for the pressing element is a stepping motor and further comprising a motor drive element in positive engagement with the slide.

8. A sheet extracting device as claimed in claim 1 wherein the measuring device is a displacement sensor arranged between the slide and the cassette.

9. A sheet extracting device as claimed in claim 8 wherein the displacement sensor includes a position switch connected to control a switching-on state of the drive motor and which is actuated by the slide.

10. A sheet extracting device as claimed in claim 9 wherein the position switch is a set of spring contacts.

11. A sheet extracting device as claimed in claim 9 further comprising an open loop control device, and wherein the displacement sensor is a magnetic sensor connected to transmit an output signal of which is applied to the open-loop control device.

12. A sheet extracting device as claimed in claim 11 wherein the displacement sensor is an inductive displacement sensor.

13. A sheet extracting device as claimed in claim 11 wherein the open-loop control device includes a microcomputer and a driver connected to drive the drive motor and wherein the microcomputer is assigned a memory in which at least one predetermined value for a value of the output signal of the sensor corresponding to the required second force is stored.

14. The sheet extracting device as claimed in claim 13 wherein the open-loop control device comprises:

(a) means for generating a maximum first force;

(b) means for storing a corresponding maximum value;

(c) means for generating a minimum first force; and (d) means for storing a corresponding minimum value;

wherein before setting a set value corresponding to the required first force it is checked whether the set value is less than the maximum value and greater than the minimum value and then the required pressing force is set in a way resulting in the predetermined value of the second force.

15. A sheet extracting device as claimed in claim 12 wherein the open-loop control device includes a microcomputer which drives the drive motor by means of a driver and wherein the microcomputer is assigned a memory in which at least one predetermined value for a value of the output signal of the sensor corresponding to the required second force is stored.

16. The sheet extracting device as claimed in claim 12 wherein the inductive displacement sensor has a magnetic coil connected to the cassette and a rod arranged on the slide for extending into the magnetic coil.

17. A sheet extracting device as claimed in claim 1 wherein the slide has a front end which faces the extracting elements and a bearing means for the end face of the stack of sheets facing away from the pressing element the pressing element is comprised of a pressing slide and a pressing plate, the pressing plate being movable in relation to the pressing slide in the pressing direction by a displacement-dependent force, and wherein the measuring device is comprised of a displacement sensor between the pressing plate and the pressing slide.

18. A sheet extracting device as claimed in claim 17, further comprising a scissors-type linkage wherein the pressing plate is mounted on the pressing slide by means of the scissors-type linkage.

19. A sheet extracting device as claimed in claim 18 wherein the spring arrangement includes springs in compression.

20. A sheet extracting device as claimed in claim 19 further comprising a spring arrangement which provides the force acting between pressing slide and pressing plate.

21. A sheet extracting device as claimed in claim 20 wherein the spring arrangement supported on the pressing slide is operably connected to act on a joint of the scissors-type linkage.

22. A sheet extracting device as claimed in claim 1 further comprising rollers mounting the slide in the cassette.

* * * * *